US007697856B2

(12) United States Patent
Tsuboi et al.

(10) Patent No.: US 7,697,856 B2
(45) Date of Patent: Apr. 13, 2010

(54) IMAGE FORMING APPARATUS AND METHOD FOR DETECTING SEPARATED STATE OF TRANSFER UNIT

(75) Inventors: Toshio Tsuboi, Okazaki (JP); Masaki Tanaka, Toyohashi (JP); Tatsuya Isono, Toyohashi (JP); Mitsuru Obara, Toyohashi (JP); Katsuyuki Hirata, Toyokawa (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 0 days.

(21) Appl. No.: 11/704,237

(22) Filed: Feb. 9, 2007

(65) Prior Publication Data

US 2007/0217801 A1 Sep. 20, 2007

(30) Foreign Application Priority Data

Mar. 16, 2006 (JP) ..... 2006-072557

(51) Int. Cl.
*G03G 15/00* (2006.01)

(52) U.S. Cl. ..... 399/49

(58) Field of Classification Search ..... 399/49, 399/66, 121

See application file for complete search history.

(56) References Cited

U.S. PATENT DOCUMENTS

2006/0280520 A1* 12/2006 Inada ..... 399/121

FOREIGN PATENT DOCUMENTS

| | | |
|---|---|---|
| JP | 2004264455 | 9/2004 |
| JP | 2005037667 | 2/2005 |

* cited by examiner

*Primary Examiner*—Quana M Grainger
(74) *Attorney, Agent, or Firm*—Morrison & Foerster LLP

(57) ABSTRACT

An image forming apparatus has a structure in which a toner image formed in an electrophotographic process is transferred from an intermediate transfer belt to a member to be transferred. The apparatus includes a secondary transfer roller that becomes a pressure contact state with respect to the intermediate transfer belt to make it perform a transfer process and can move between the pressure contact state and a separated state, and a press and separation driving device for driving the secondary transfer roller to become the pressure contact state and the separated state. The pressure contact state or the separated state of the secondary transfer roller is detected in accordance with a variation of an output of an IDC sensor for detecting a state of a bare surface of the intermediate transfer belt.

6 Claims, 13 Drawing Sheets

SEPARATED CASE

PRESSURE CONTACT CASE

SEPARATED CASE

PRESSURE CONTACT CASE

IMAGE FORMING APPARATUS AND METHOD FOR DETECTING SEPARATED STATE OF TRANSFER UNIT

This application is based on Japanese patent application No. 2006-072557 filed on Mar. 16, 2006, the contents of which are hereby incorporated by reference.

BACKGROUND OF THE INVENTION

1. Field of the Invention

The present invention relates to an image forming apparatus such as a copying machine, a printer, an MFP, a facsimile machine, or a multifunction device thereof, and a method for detecting a pressure contact or separated state of a transfer unit in the image forming apparatus. For example, the present invention can be utilized for detecting a pressure contact or separated state of a secondary transfer roller with respect to an intermediate transfer belt.

2. Description of the Prior Art

Conventionally, a copying machine of an electrophotographic method, a printer, a facsimile machine, or an image forming apparatus such as a multifunction device called an MFP (Multi Function Peripherals) forms images by developing an electrostatic latent image formed on a photosensitive drum so as to form a toner image, which is transferred to an intermediate transfer belt as a primary transfer and further transferred to a paper sheet as a secondary transfer, which is fixed. In order to perform the secondary transfer of the toner image from the intermediate transfer belt to the paper sheet, there is provided a secondary transfer roller that becomes a pressure contact state with respect to the intermediate transfer belt that is an image carrier.

In this image forming apparatus, the secondary transfer roller can move with respect to the intermediate transfer belt between the pressure contact state and the separated state. Although the secondary transfer roller is in the pressure contact state in a normal image forming (printing) state, it is usually in the separated state while the image forming process is not performed.

In another conventional structure, a test toner patch (an image stabilizer pattern) is formed on the intermediate transfer belt or the photosensitive drum, and a state of the toner patch is detected by an IDC sensor that is a density detector so that conditions for forming an image are adjusted. In this case too, the secondary transfer roller is usually set to be in the separated state so that the secondary transfer roller or the like does not become dirty with the toner.

Furthermore, a press and separation driving device is provided for moving the secondary transfer roller, and an optical sensor such as a photointerrupter is used for detecting whether or not the secondary transfer roller is switched securely to the separated state or the pressure contact state by the press and separation driving device.

However, if the photointerrupter is used for detecting the pressure contact state and the separated state, the number of components increases, which causes increase of cost. On the other hand, Japanese unexamined patent publication No. 2004-264455 discloses a device that does not include a special-purpose photointerrupter, but a photointerrupter for detecting a paper jam is also used for the above-mentioned purpose.

However, a single photointerrupter is shared for detecting timings of paper arrival and pass and for detecting the pressed or separated state of the secondary transfer roller in the above-mentioned conventional device. Therefore, it is necessary to use a special pre-transfer sensor flag for detecting arrival and pass timings of a paper sheet, so an operation of detecting a paper jam or the like may be subject to some constraints.

SUMMARY OF THE INVENTION

An object of the present invention is to provide an image forming apparatus and a method for detecting a pressure contact or separated state of a transfer unit at a low cost without using a photointerrupter.

The apparatus according to one aspect of the present invention is an image forming apparatus having a structure in which a toner image formed in an electrophotographic process is transferred from an image carrier to a member to be transferred. The apparatus includes a transfer unit that becomes a pressure contact state with respect to the image carrier to make the same perform a transfer process and can move between the pressure contact state and a separated state, and a press and separation driving device for driving the transfer unit to become the pressure contact state and the separated state. The pressure contact state or the separated state of the transfer unit is detected in accordance with a variation of an output of a detector for detecting a state of a bare surface of the image carrier.

According to the present invention, the pressure contact or separated state of the transfer unit can be detected at a low cost without using a photointerrupter.

DESCRIPTION OF THE PREFERRED EMBODIMENTS

The invention will now be described in detail with reference to the attached drawings.

Figure 1:
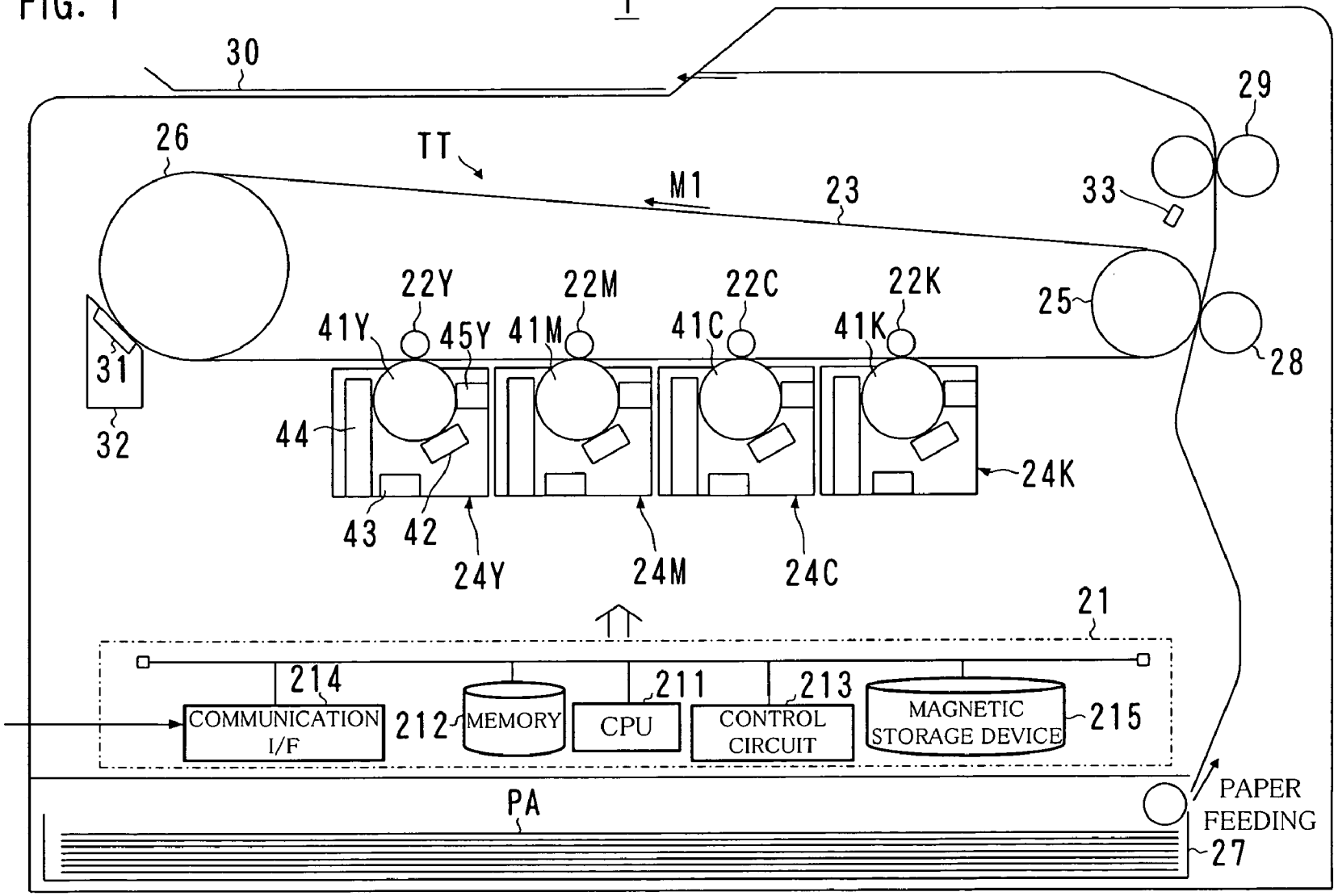
FIG. 1 is a diagram showing a general structure of an image forming apparatus according to an embodiment of the present invention.
Figure 2:
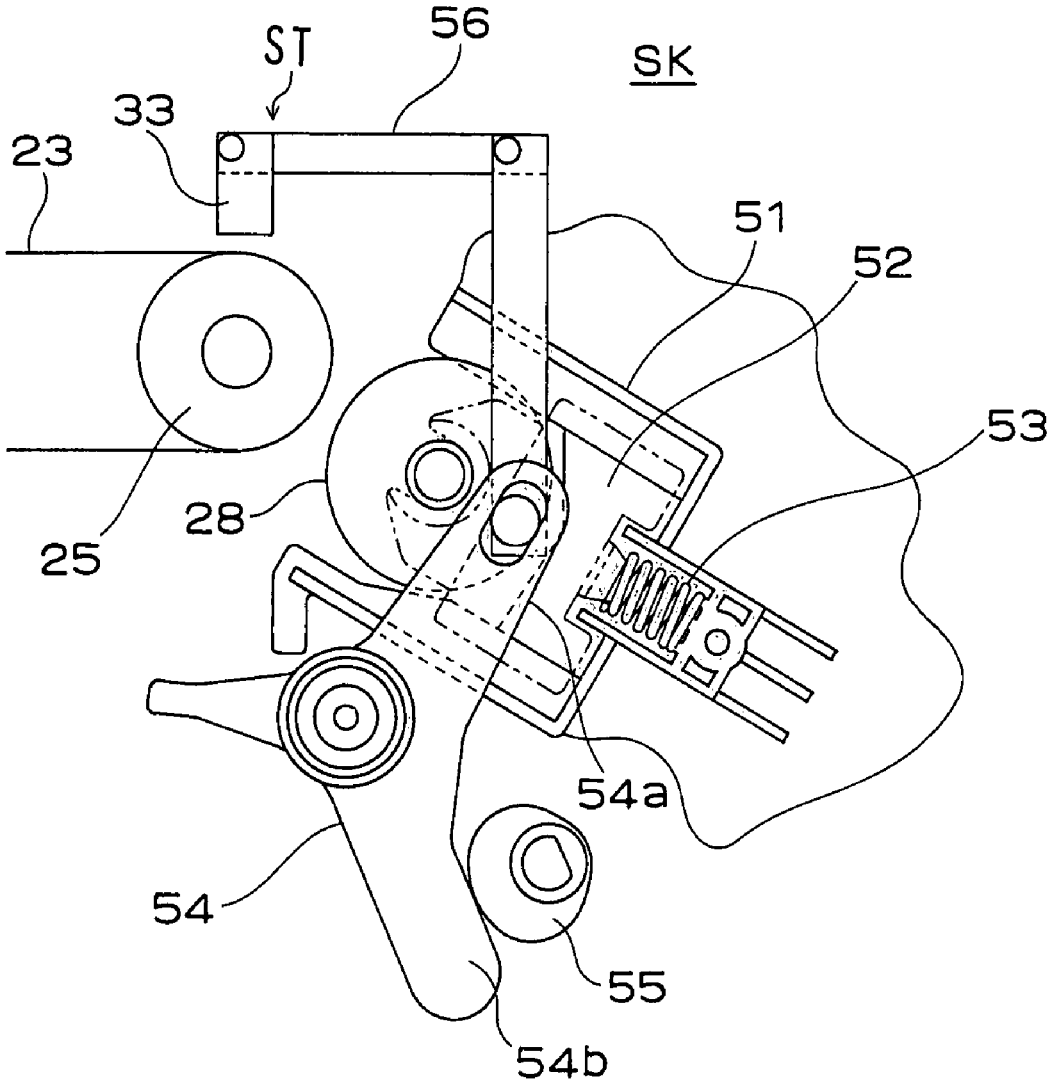
FIG. 2 is a diagram showing an example of a structure of a press and separation driving device.
Figure 3:
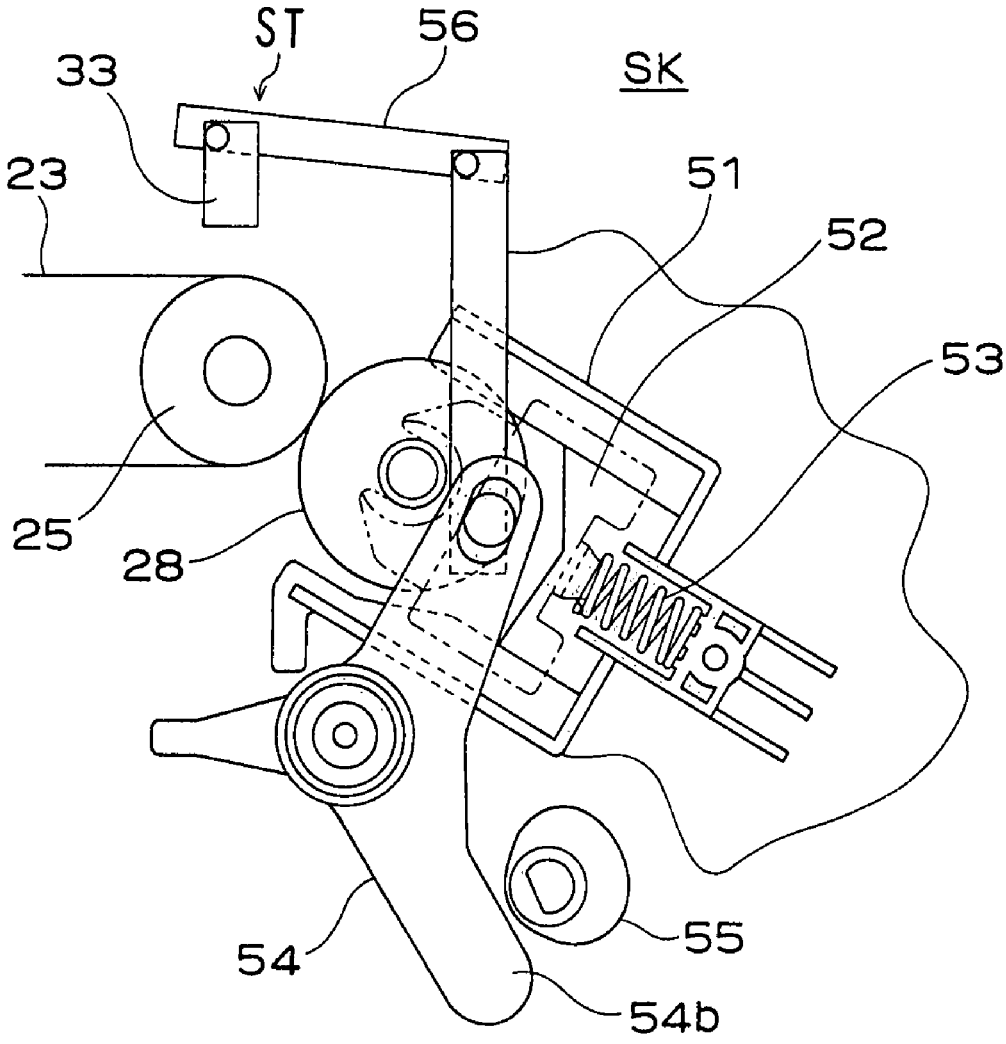
FIG. 3 is a diagram showing an example of a structure of the press and separation driving device.
Figure 4:
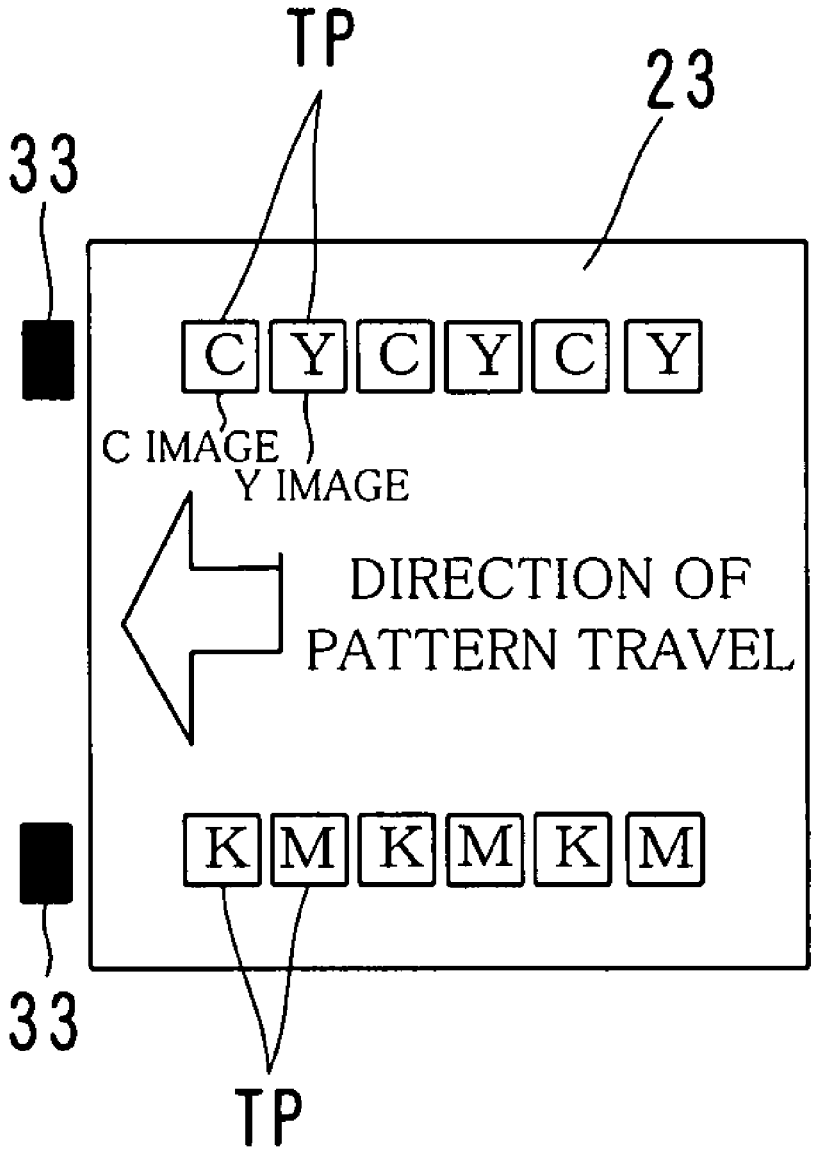
FIG. 4 is a diagram showing an example of a toner patch.
Figure 5:
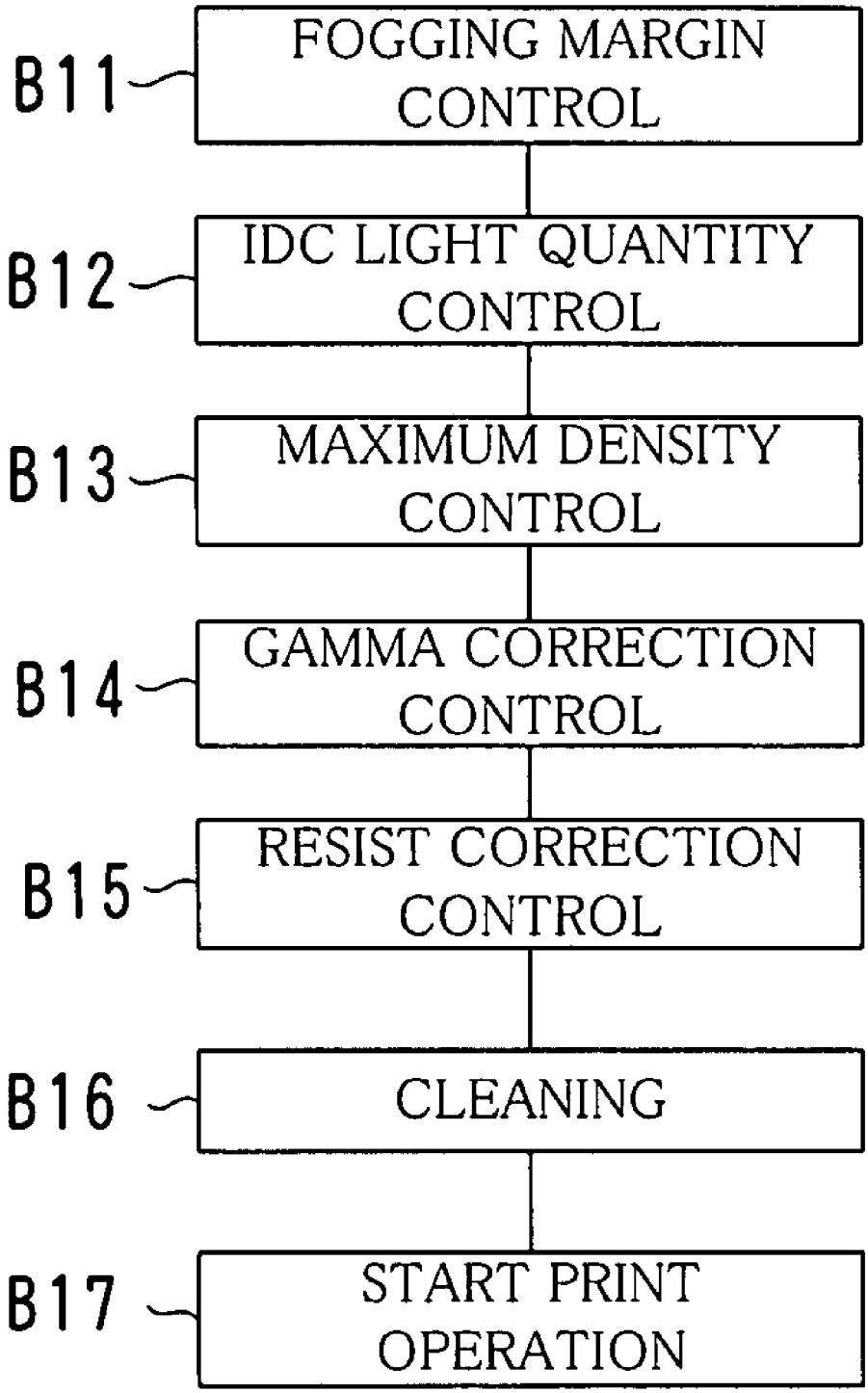
FIG. 5 is a block diagram of an operation for stabilization.

FIG. 1 is a diagram showing a general structure of an image forming apparatus 1 according to an embodiment of the present invention, FIGS. 2 and 3 are diagrams showing an example of a structure of a press and separation driving device SK, FIG. 4 shows an example of a toner patch, and FIG. 5 is a block diagram of an operation for stabilization. Note that FIG. 2 shows the case where a secondary transfer roller is in the separated state while FIG. 3 shows the case where the secondary transfer roller is in the pressure contact state.

As shown in FIG. 1, the image forming apparatus 1 is a digital mutifunction device or a printer that utilizes an electrophotographic technique and includes a tandem type print engine.

More specifically, the image forming device 1 includes image forming units 24Y, 24M, 24C and 24K of Y (yellow), M (magenta), C (cyan) and K (black) arranged in a line as a tandem system. Each of the image forming units 24Y, 24M, 24C and 24K includes a photosensitive drum 41, an electro static charger 42 for electrifying a surface of the photosensitive drum 41 uniformly, an exposure portion 43 for exposing the surface of the photosensitive drum 41 to light in accordance with image data of each color so that an electrostatic latent image is formed, a development portion 44 for developing the electrostatic latent image with toner of each color so that a toner image is formed, a transfer roller 22 arranged in a position that is opposed to the photosensitive drum 41 of each color via an intermediate transfer belt 23, and a cleaner 45 for cleaning and collecting toner remaining on the surface of the photosensitive drum 41.

Note that each of the members corresponding to each color of Y, M, C or K may be denoted by a suffix Y, M, C or K in this specification and the attached drawings.

The intermediate transfer belt 23 is tensioned between rollers 25 and 26 along the upper portion of each of the photosensitive drums 41Y, 41M, 41C and 41K, and is driven by the roller 25 to run in the direction indicated by an arrow Ml shown in FIG. 1. Each of the transfer rollers 22Y, 22M, 22C and 22K can be moved between a pressed position where the intermediate transfer belt 23 is pressed to each of the photosensitive drums 41Y, 41M, 41C and 41K and a separated position where the intermediate transfer belt 23 is separated (also referred to as spaced or saved) from each of the photosensitive drums 41Y, 41M, 41C and 41K. When the intermediate transfer belt 23 is pressed to the photosensitive drum 41Y, 41M, 41C or 41K, a toner image of the photosensitive drum 41 is transferred to the intermediate transfer belt 23 as a primary transfer.

The toner image transferred to the intermediate transfer belt 23 as the primary transfer is further transferred by a secondary transfer roller 28 as a secondary transfer to a paper sheet PA, which is a member to be transferred, fed by a paper feed cassette 27. After that, the toner image on the paper sheet PA is fixed in a fixing portion 29 and the paper sheet PA is delivered to a paper delivering tray 30. The secondary transfer roller 28 is switched between the pressure contact state and the separated state with respect to the intermediate transfer belt 23 by a press and separation driving device (a press and separation mechanism) being various types or having various structures. At the vicinity of the roller 26, there are provided a belt cleaner 31 and a waste toner box 32.

At the vicinity of the roller 25, there is provided an optical IDC sensor 33 that is a density detector for detecting density of a toner image on the intermediate transfer belt 23. More specifically, the IDC sensor 33 projects light to a surface of the intermediate transfer belt 23 and detects returning light after reflected by the same. It is possible to control quantity of light emitted from the IDC sensor 33. In addition, a light emission portion may be a light projector that is separated from the IDC sensor 33.

If the density of the toner image on the intermediate transfer belt 23 is low, i.e., if there is little toner on the intermediate transfer belt 23, much light is reflected by the intermediate transfer belt 23 and quantity of the returning light increases. If the density of the toner image is high, i.e., if there is much toner on the intermediate transfer belt 23, light is interrupted by the toner so that quantity of the reflected light decreases. In this way, the IDC sensor 33 can recognize a state of a bare surface of the intermediate transfer belt 23. The density of the toner image detected by the IDC sensor 33 is used for controlling quantity of light from the exposure portion 43 or controlling conditions for development in the development portion 44, and the like for an image adjustment. Actually, the density is detected for each pattern (toner patch) of Y, M, C and K that was generated for the image adjustment.

Although two IDC sensors 33 are provided in this embodiment, it is possible to provide one or three or more IDC sensors 33. In addition, the position where the IDC sensor 33 is attached and a method for attaching the same are not limited to those described above. Other various positions and methods may be adopted.

A control portion 21 includes a CPU 211, a memory 212, a control circuit 213, a communication interface 214 and a magnetic storage device 215. The control portion 21 performs an image process on image data and controls an operation of each portion of the image forming apparatus 1. Hereinafter, in particular, a detection process of a pressure contact or separated state of the secondary transfer roller 28 with respect to the intermediate transfer belt 23 and its control will be described in detail.

Note that the image forming means or method, and the structure or the configuration of each portion of the image forming apparatus 1 are not limited to the example described above. In addition, the image forming apparatus 1 may be a monochrome or a color copying machine, a printer, a facsimile, a mutifunction device thereof or the like.

As shown in FIGS. 2 and 3, the press and separation driving device SK is provided with a holder 51 and a slider 52 held by the holder 51 in a movable manner. The slider 52 retains the rotation axis of the secondary transfer roller 28 and slides with respect to the holder 51. Thus, the slider 52 retains the secondary transfer roller 28 in a movable manner between the separated position (a state shown in FIG. 2) and the pressed position (a state shown in FIG. 3). The holder 51 is provided with a spring 53, and a slider 52 is pressed by the spring 53 toward the pressed position.

In order to return the secondary transfer roller 28 to the separated position, there is a lever 54 that can rotate around an axis having a predetermined position relationship with the holder 51 as well as a cam 55 that is driven to rotate by a motor (not shown). One arm 54*a* of the lever 54 is provided with an elliptic hole that engages a protruding portion of the slider 52. The other arm 54*b* is abutted and pressed by the rotating cam 55, thereby the lever 54 rotates.

In the state shown in FIG. 2, the arm 54*b* is pressed by the cam 55, so that the lever 54 rotates clockwise and moves the slider 52 against the pressing force of the spring 53. Thus, the secondary transfer roller 28 is in the separated position.

In the state shown in FIG. 3, the arm 54*b* is free from the cam 55, so that the secondary transfer roller 28 is pressed by the spring 53 to be in the pressed position.

In addition, the IDC sensor 33 is attached to an end portion of a movable unit 56 that changes its posture in accordance with the slider 52 or the lever 54, so it moves only in the vertical direction in the drawing when the lever 54 moves. More specifically, when the secondary transfer roller 28 becomes the separated state as shown in FIG. 2, the IDC sensor 33 approaches the intermediate transfer belt 23. When the secondary transfer roller 28 becomes the pressure contact state as shown in FIG. 3, the IDC sensor 33 is separated from the intermediate transfer belt 23.

Next, the image adjustment by the IDC sensor 33 will be described.

The image adjustment (image stabilization operation) includes adjustment of image density and gradation of each color at a predetermined time interval for reducing variation of image quality due to alteration of environment, variation with time or the like.

In the image adjustment, process conditions including predetermined system speed, exposure, development bias, electrification potential and the like are set, and then the toner patch is formed on the intermediate transfer belt 23. A density of the toner patch, i.e., a quantity of toner (a quantity of attached toner) and a quantity of position shift of each color is detected by the IDC sensor 33.

As shown in FIG. 4, the toner patch TP is formed at a position close to each end of the surface of the intermediate transfer belt 23 and moves together with the intermediate transfer belt 23 when it runs. This movement is detected by two IDC sensors 33. The IDC sensor 33 outputs a voltage corresponding to a density of the toner patch TP. This voltage output (a sensor output) S3 is converted into the quantity of attached toner in accordance with the characteristics of the IDC sensor 33. In accordance with the converted quantity of attached toner, an electrification voltage of the photosensitive drum 41, a development bias voltage of the same and a quantity of light in the exposure portion 43 and the like are adjusted so that a desired quantity of attached toner is obtained.

As shown in FIG. 5, a fogging margin control (B11), an IDC light quantity control (B12), a maximum density control (B13), a gamma correction control (B14), a resist correction control (B15), and cleaning (B16) are performed in this order in the stabilization control. During this process, the secondary transfer roller 28 is in the separated state.

More specifically, since the toner patch TP is formed on the surface of the intermediate transfer belt 23 during the image adjustment, if the secondary transfer roller 28 is in the pressure contact state with respect to the intermediate transfer belt 23, the secondary transfer roller 28 may becomes dirty. In addition, the rear side of a paper sheet PA may become dirty with toner during the normal printing. In order to avoid these problems, it is necessary to set the secondary transfer roller 28 in the separated state when the image adjustment is performed.

Therefore, when the image adjustment is performed, a separation instruction S2 is issued, and the press and separation driving device SK works so that the secondary transfer roller 28 becomes the separated state. After a press and separation detecting device ST that is made up of the IDC sensor 33 and the like detects the separated state, a sequence of the image adjustment is performed.

Note that the arrangement and the number of toner patches TP, the contents and the order of the stabilization control or the like are not limited to the example described above, but other various structures can be adopted. The IDC sensor 33 may be an optical type, an ultrasonic type, a magnetic type, or other various types or structures of sensor. The number and arrangement of IDC sensors 33 are also not limited to the example described above.

Next, the press and separation detection device ST will be described, which is used for detecting whether the secondary transfer roller 28 is in the pressure contact state or in the separated state. Note that the press and separation detection device ST is made up of the IDC sensor 33, a movable unit 56, the control portion 21 and the like. More specifically, the control portion 21 realizes a determination portion for determining pressure contact or separated state based on the sensor output signal S3 and for determining an abnormal state, a NIP width control portion for controlling a NIP width and the like. The determination portion or the control portion can be made up of hardware, software or a combination thereof.

In the press and separation detection device ST, the IDC sensor 33 detects a state of the bare surface of the intermediate transfer belt 23, i.e., a state of the surface to which toner is not attached. Then, in accordance with variation of an output signal S3 of the IDC sensor 33 as a detection result, a pressure contact or separated state of the secondary transfer roller 28 is detected. In this case, according to this embodiment, if the output signal S3 of the IDC sensor 33 has a value higher than a threshold value Th, it is determined that the secondary transfer roller 28 is in the separated state.

Figure 6A:
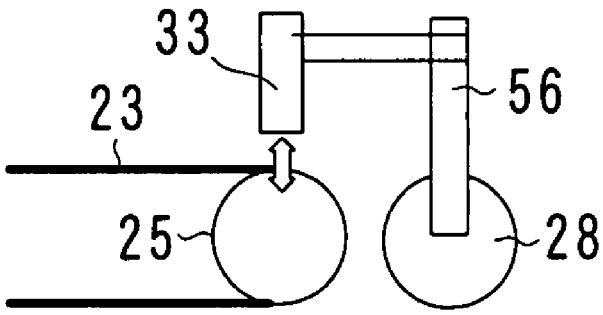
FIGS. 6A and 6B show schematically a moving structure of an IDC sensor.
Figure 6B:
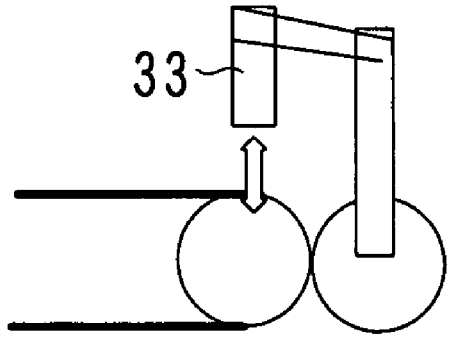
Figure 7:
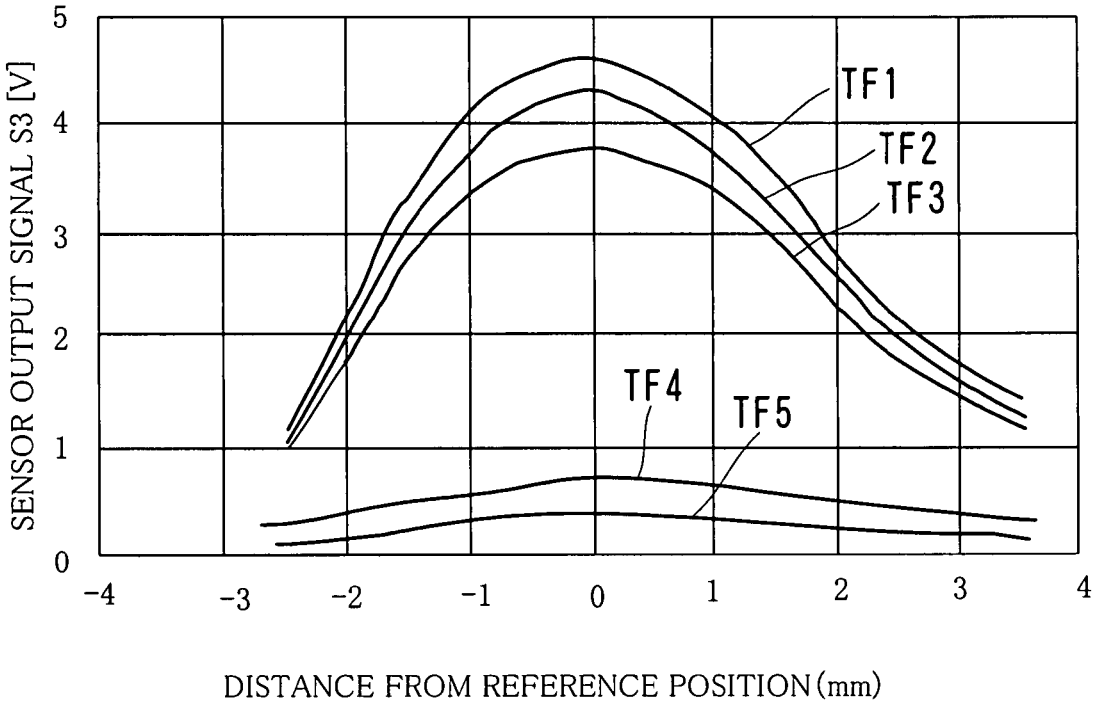
FIG. 7 is a graph showing distance characteristics of the IDC sensor.
Figure 8:
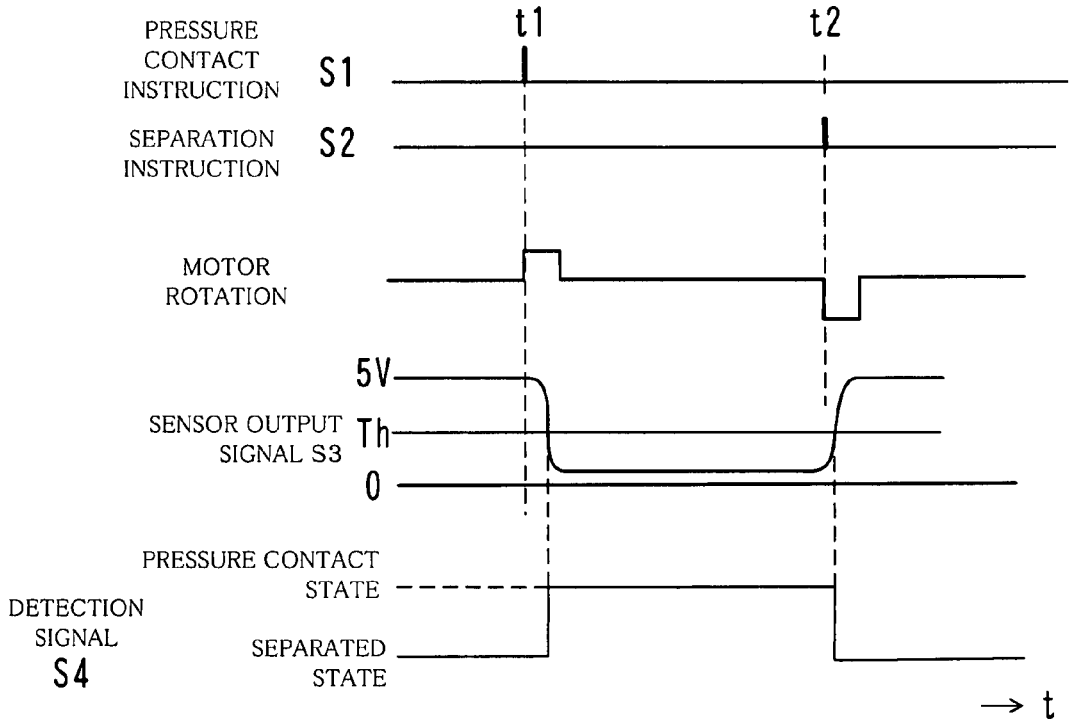
FIG. 8 is a timing chart showing a press and separation detection operation.

FIGS. 6A and 6B show schematically a moving structure of the IDC sensor 33, FIG. 7 shows distance characteristics of the IDC sensor 33, and FIG. 8 is a timing chart showing a press and separation detection operation.

As shown in FIG. 7, the output signal S3 of the IDC sensor 33 varies corresponding to a distance from a position (a reference position). Note that in FIG. 7 curves TF1-TF5 indicate sensor output signals S3 when the quantity of attached toner is "0", "0.27", "0.60", "2.40" and "5.13", respectively. The curve TF1 is the sensor output signal S3 when the bare surface of the intermediate transfer belt 23 is detected.

Therefore, as shown in FIGS. 2 and 6A, a distance between the IDC sensor 33 and the intermediate transfer belt 23 is adjusted so that the output signal S3 of the IDC sensor 33 has the maximum value when the secondary transfer roller 28 is in the separated state, i.e., when the IDC sensor 33 is closest to the intermediate transfer belt 23 being driven by the movable unit 56. A position of the IDC sensor 33 in this state is regarded as the reference position.

When the IDC sensor 33 detects a pressure contact or separated state, the bare surface of the intermediate transfer belt 23 is detected. In this state, the output signal S3 of the IDC sensor 33 has a value of 4.5 V in the example shown in FIG. 7.

On the other hand, as shown in FIGS. 3 and 6B, when the secondary transfer roller 28 is in the pressure contact state, the IDC sensor 33 is moved upward away from the intermediate transfer belt 23. Therefore, the distance is larger than the reference position, so that the output signal S3 of the IDC sensor 33 is decreased in voltage.

For example, if it is configured that the IDC sensor 33 is moved upward from the reference position by 3 mm in the pressure contact state compared with the separated state, the output signal S3 of the IDC sensor 33 has 1.88 V (see FIG. 7). If the threshold value Th is set to 3 V, for example, the separated state can be distinguished from the pressure contact state.

More specifically, as shown in FIG. 8, if a pressure contact instruction S1 is issued, for example, in the control portion 21 at the time point t1 after the separated state, a motor (not shown) that is provided in the press and separation driving device SK drives a cam 55 to rotate, so that the secondary transfer roller 28 moves from the separated state to the pressure contact state. As a result, the IDC sensor 33 that detects the bare surface of the intermediate transfer belt 23 becomes apart from the intermediate transfer belt 23, so a voltage of its output signal S3 decreases.

Therefore, setting the threshold value Th to an appropriate level, switching from the separated state to the pressure contact state can be detected, and a detection signal S4 thereof is outputted.

When the separation instruction S2 is outputted at the time point t2, the motor (not shown) drives the cam 55 to rotate in the opposite direction, so that the secondary transfer roller 28 moves from the pressure contact state to the separated state. Note that the cam 55 may be rotated in the same direction. As a result, the IDC sensor 33 becomes close to the intermediate transfer belt 23 and returns to the reference position, so that the sensor output signal S3 increases in voltage. When the sensor output signal S3 becomes higher than the threshold value Th, it is detected that the secondary transfer roller 28 is switched from the pressure contact state to the separated state, and the detection signal S4 thereof is outputted.

Note that it is possible to wait a time period of several seconds, e.g., five seconds after the output of the separation instruction S2 until the determination whether the switching to the separated state is completed.

In accordance with the detection signal S4, a sequence of image formation, image adjustment or the like is performed. In addition, if the detection signal S4 is not outputted at a predetermined timing, an abnormal signal or an error signal is outputted. Note that the detection signal S4 may be a binary signal indicating the pressure contact state or the separated state, or it may be a two-bit signal indicating each of the states. In addition, it may be an electrical and physical signal or an internal signal such as a flag in software of data processing.

Note that a value of the sensor output signal S3 is merely an example. In addition, a relationship between the sensor output signal S3 and the pressure contact or separated state may be opposite to that described above. It is possible to set the sensor output signal S3 to have a large value in the pressure contact state.

There may be the case where the detection signal S4 indicating the pressure contact or separated state is not outputted after the pressure contact instruction S1 or the separation instruction S2 is outputted because a trouble of the press and separation driving device SK or the like. Next, an example of a process operation in that case will be described.

For example, if the detection signal S4 indicating being in the separated state is not outputted during a predetermined time period after the separation instruction S2 is outputted, i.e., after the secondary transfer roller 28 is driven to be in the separated state, the separation instruction S2 is outputted again, so that the press and separation driving device SK drives again the secondary transfer roller 28 to be in the separated state.

In addition, if the detection signal S4 indicating being in the separated state is not outputted even if a predetermined time has passed after the separation instruction S2 was outputted or even if the separation instruction S2 was outputted a predetermined number n of times, e.g., three times for example, a signal indicating an abnormal state is outputted.

For example, if the sensor output signal S3 does not become higher than or equal to 3 V that is the threshold value Th even after the separating operation is performed by the separation instruction S2, or if the sensor output signal S3 does not become lower than or equal to 3 V after the pressure contact operation is performed by the pressure contact instruction S1, an abnormal state is determined, so that the separating operation or the pressure contact operation is retried.

In addition, it may be structured to output again the pressure contact instruction S1 or the abnormal signal in the same way as described above also in the case where a predetermined time has passed after the pressure contact instruction S1 is outputted or the case where the pressure contact instruction S1 has been outputted a predetermined number of times.

Next, an example will be described where a control of the NIP width is performed in synchronization with variation of the sensor output signal S3.

It is possible to perform the control of the NIP width of the intermediate transfer belt 23 and the secondary transfer roller 28 based on the sensor output signal S3 after the press and separation driving device SK drove the secondary transfer roller 28 to be in the separated state.

The NIP width means a contact width between the secondary transfer roller 28 and the opposed roller 25 or the intermediate transfer belt 23. In the contacting or separating operation of the secondary transfer roller 28, after the separating operation is performed responding to the separation instruction S2, the NIP width of the secondary transfer roller 28 and the intermediate transfer belt 23 that is a carrier of the toner image is controlled based on a value of the sensor output signal S3.

For example, if the sensor output signal S3 at the NIP width to be a target has 1.8 V, the secondary transfer roller 28 should be moved by the rotation of the cam 55 so that the sensor output signal S3 has 1.8 V.

Next, an example of a control operation of the press and separation detection device ST will be described with reference to flowcharts.

Figure 9:
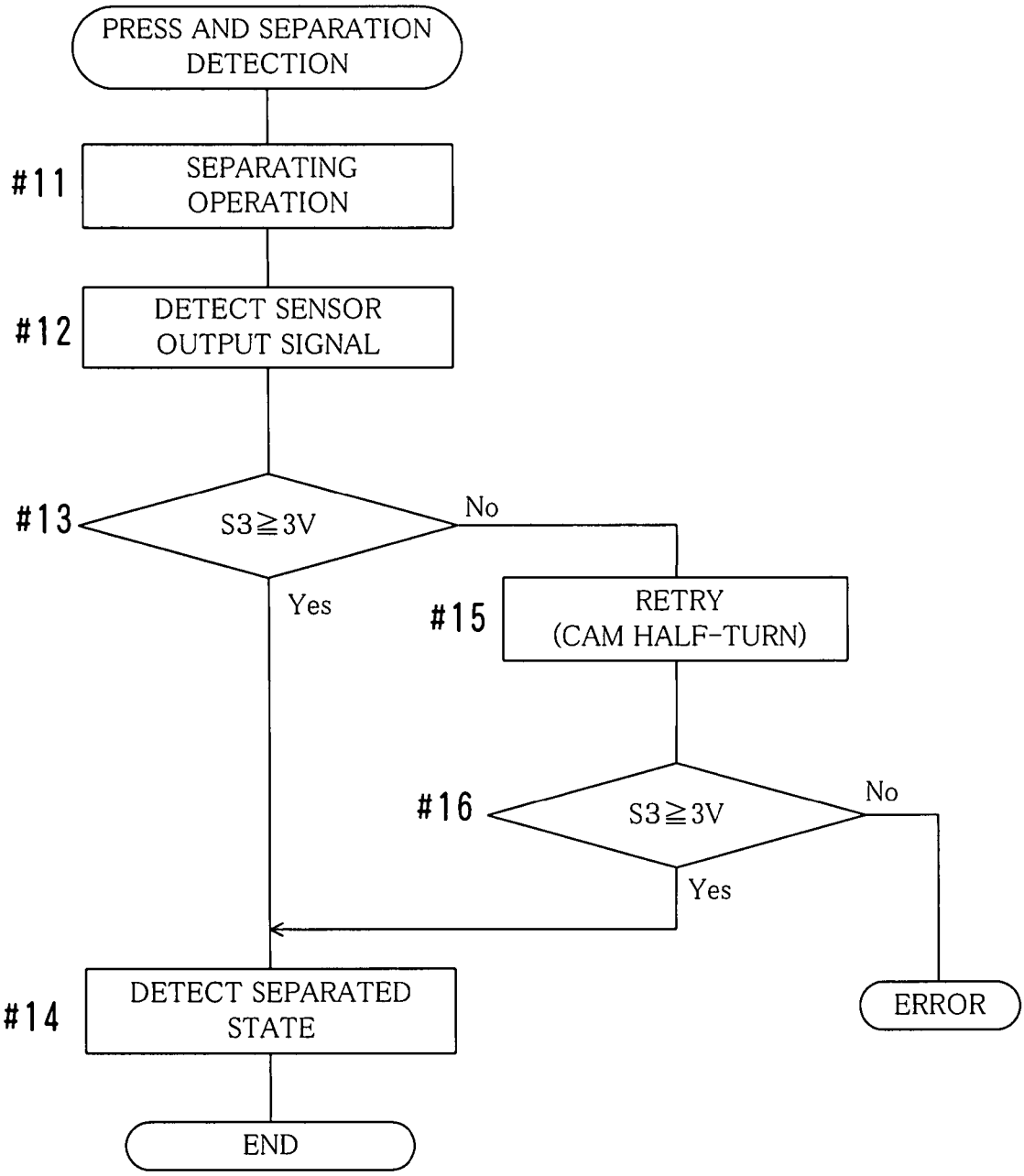
FIG. 9 is a flowchart showing an example of an operation for detecting a separated state performed by the press and separation detection device.
Figure 10:
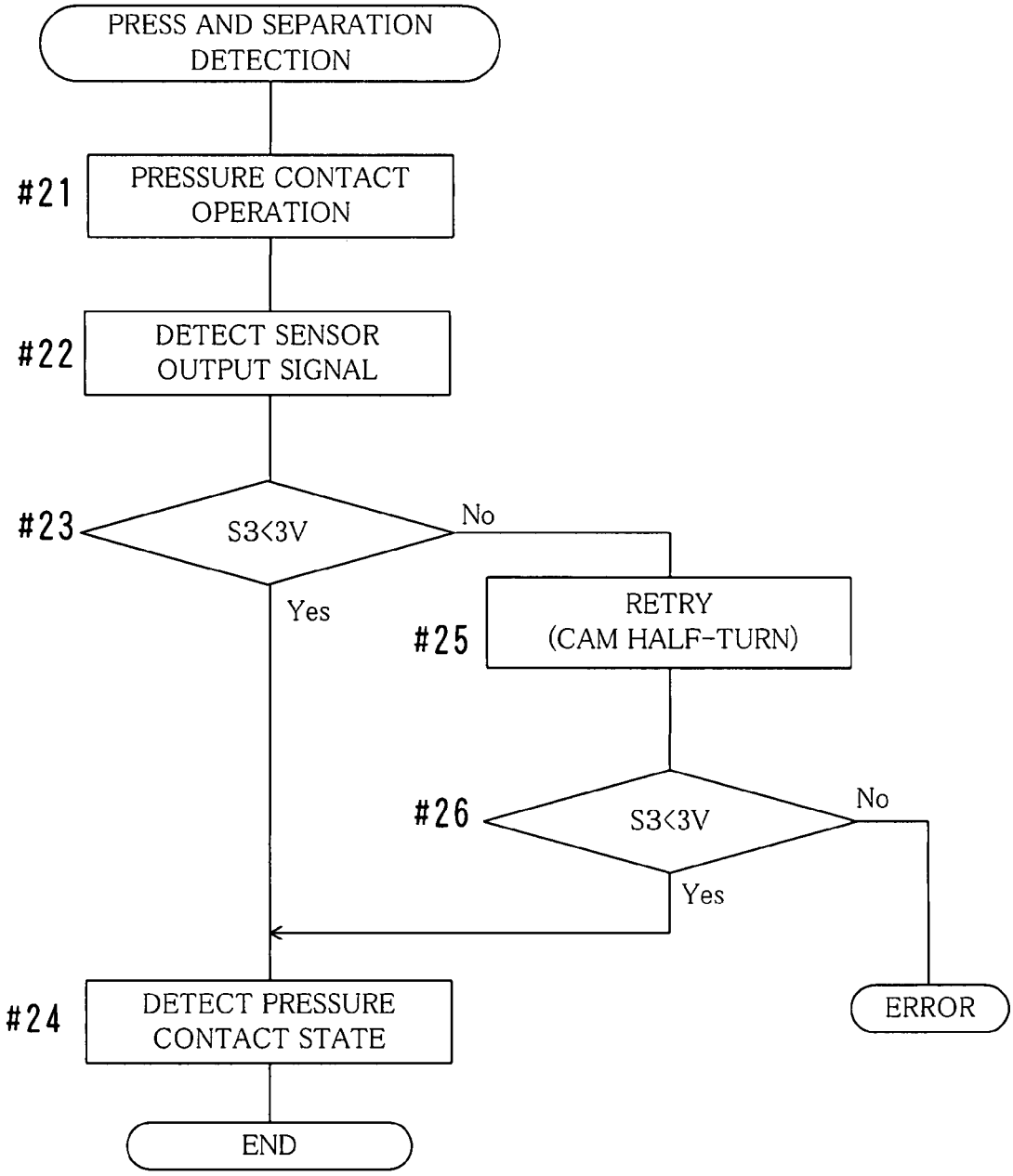
FIG. 10 is a flowchart showing an example of an operation for detecting a pressure contact state performed by the press and separation detection device.
Figure 11:
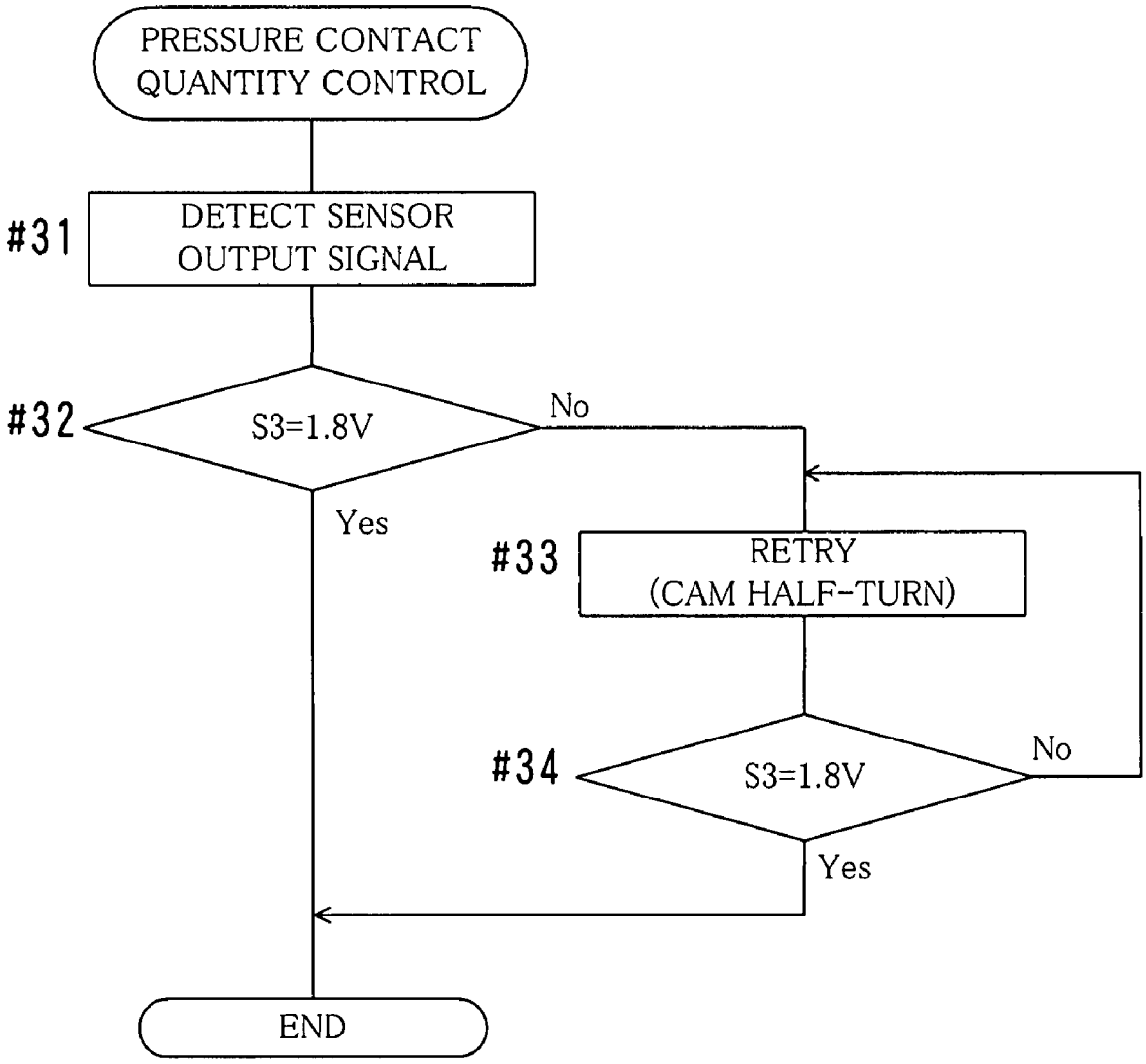
FIG. 11 is a flowchart showing an example of a control of an NIP width performed by using a sensor output signal S3.

FIG. 9 is a flowchart showing an example of a detection operation of the separated state performed by the press and separation detection device ST, FIG. 10 is a flowchart showing an example of a detection operation of the pressure contact state performed by the press and separation detection device ST, and FIG. 11 is a flowchart showing an example of the NIP width control performed by using the sensor output signal S3.

As shown in FIG. 9, the separating operation is started (#11), and the sensor output signal S3 is detected (#12). If the sensor output signal S3 is higher than or equal to 3 V that is the threshold value Th (Yes in #13), it is decided that it is in the separated state (#14). If the sensor output signal S3 is less than or equal to 3 V (No in #13), a retrying step is performed (#15). As a result, if the sensor output signal S3 becomes higher than or equal to 3 V (Yes in #16), it is decided that it becomes the separated state normally (#14). If the sensor output signal S3 does not become higher than or equal to 3 V (No in #16), it is decided that an error has occurred.

In FIG. 10, the pressure contact operation is started (#21), and the sensor output signal S3 is detected (#22). If the sensor output signal S3 is lower than or equal to 3 V that is the threshold value Th (Yes in #23), it is decided that it is in the pressure contact state (#24). If the sensor output signal S3 is higher than or equal to 3 V (No in #23), a retrying step is performed (#25). As a result, if the sensor output signal S3 becomes lower than or equal to 3 V (Yes in #26), it is decided that it becomes the pressure contact state (#24). If the sensor output signal S3 does not become lower than or equal to 3 V (No in #26), it is decided that an error has occurred.

In FIG. 11, the sensor output signal S3 is detected (#31). If it is 1.8 V (#32), the process is finished as it is. If the sensor output signal S3 is not 1.8 V, the NIP width (pressure contact quantity) is adjusted by rotation of the cam 55 so that the sensor output signal S3 becomes 1.8 V.

The embodiment described above is an example where the IDC sensor 33 is a movable type so that the distance of the IDC sensor 33 is changed. It may be structured in such a way that a posture of the IDC sensor 33 is changed with respect to the bare surface of the intermediate transfer belt 23.

Figure 12A:
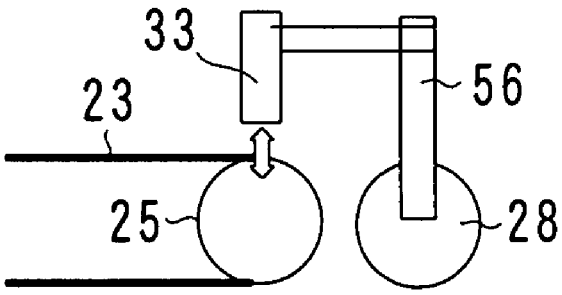
FIGS. 12A and 12B show schematically another example of the moving structure of the IDC sensor.
Figure 12B:
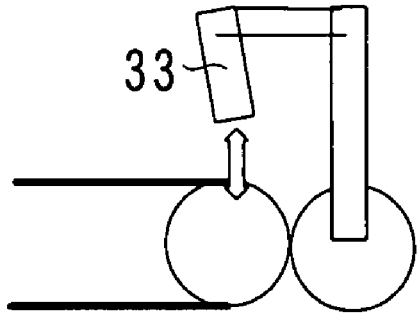

FIGS. 12A and 12B show schematically another example of the moving structure of the IDC sensor 33.

In FIGS. 12A and 12B, the movable unit 56 changes its position corresponding to the pressure contact or separated state of the secondary transfer roller 28 so that an angle of the IDC sensor 33 is altered with respect to the bare surface of the intermediate transfer belt 23. More specifically, when the detection angle of the IDC sensor 33 is altered, the distance to the bare surface of the intermediate transfer belt 23 that is a detection surface is also altered, so that the sensor output signal S3 is altered. The pressure contact or separated state of the secondary transfer roller 28 is detected based on the variation of the sensor output signal S3.

In addition, it is possible to provide the IDC sensor 33 fixedly so as to detect the secondary transfer roller 28 without moving the IDC sensor 33.

Figure 13A:
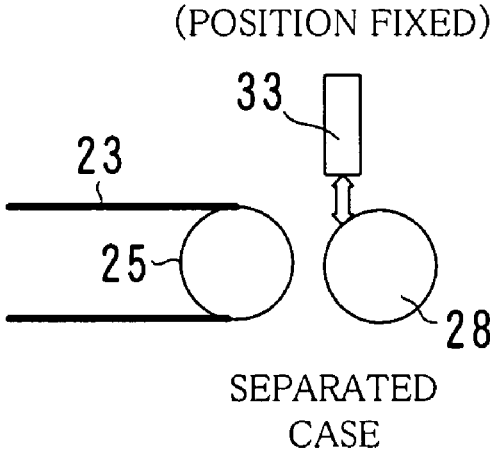
FIGS. 13A and 13B show schematically an example of the case where the IDC sensor is attached fixedly.
Figure 13B:
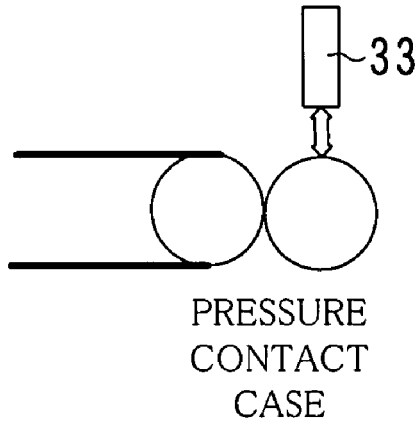

FIGS. 13A and 13B show schematically an example of the case where the IDC sensor 33 is attached fixedly.

In FIGS. 13A and 13B, the IDC sensor 33 is fixed to a position that is above the secondary transfer roller 28 and is right above the center axis of the secondary transfer roller 28 in the pressure contact state. In the separated state, the IDC sensor 33 is at the position shifted from the center axis of the secondary transfer roller 28 when the secondary transfer roller 28 is moved. As a result, the sensor output signal S3 is lowered. Based on such a variation of the sensor output signal S3, the pressure contact or separated state of the secondary transfer roller 28 can be detected.

In this case too, detection of the abnormal state of the press and separation driving device SK, the NIP width control and the like can be performed in the same way as the case of the movable type.

As to a relative position between the IDC sensor 33 and the secondary transfer roller 28, it is possible that the secondary transfer roller 28 is structured to move right under the IDC sensor 33 when it becomes the separated state. It is possible to use not the IDC sensor 33 but another detection sensor.

According to the embodiment described above, the pressure contact or separated state of the secondary transfer roller 28 can be detected easily at a low cost without using a special detection device such as a photointerrupter. More specifically, whether the secondary transfer roller 28 is in the pressure contact state or in the separated state can be decided based on the sensor output signal S3 when the IDC sensor 33 detects the bare surface state, so the special sensor for detecting the pressure contact or the separated state of the secondary transfer roller 28 can be eliminated, resulting in a cost reduction.

In the embodiment described above, the case where the IDC sensor 33 is a movable type and the case where it is a fixed type are explained. The present invention is not limited to these cases but can be any structure as long as the variation of position of the secondary transfer roller 28 is detected corresponding to the pressure contact or separated state. Although the IDC sensor 33 detects the pressure contact or separated state of the secondary transfer roller 28, it may be structured to detect the pressure contact or separated state of a primary transfer roller with respect to the photosensitive drum 41.

In the embodiment described above, the structure, the configuration, the circuit, the shape, the dimensions, the number, the material, the process contents, the process order or the like of a whole or a part of the control portion 21, the IDC sensor 33, the movable unit 56, the press and separation driving device SK, the press and separation detection device ST or the image forming apparatus 1 can be modified if necessary in accordance with the spirit of the present invention.

While example embodiments of the present invention have been shown and described, it will be understood that the present invention is not limited thereto, and that various changes and modifications may be made by those skilled in the art without departing from the scope of the invention as set forth in the appended claims and their equivalents.

What is claimed is:

1. An image forming apparatus having a structure in which a toner image formed in an electrophotographic process is transferred from an image carrier to a member to be transferred, the apparatus comprising:

a density detector for detecting a density of a toner image in the image carrier;

a transfer unit that becomes a pressure contact state with respect to the image carrier to make the image carrier perform a transfer process and can move between the pressure contact state and a separated state; and a press and separation driving device for driving the transfer unit to become the pressure contact state and the separated state, wherein the density detector is provided so that a position or a posture thereof with respect to the image carrier is altered along with a movement of the transfer unit by the press and separation driving device, and a pressure contact state or a separated state of the transfer unit is detected by the density detector based on a variation of an detection output of a bare surface state of the image carrier.

2. The image forming apparatus according to claim 1, wherein the density detector is an optical sensor for detecting a quantity of light reflected by the surface of the image carrier and outputting the same.

3. The image forming apparatus according to claim 1, wherein the press and separation driving device drives again the transfer unit to be the separated state if the output of the density detector does not indicate the separated state when a predetermined time has passed after the press and separation driving device drove the transfer unit to be the separated state.

4. The image forming apparatus according to claim 1, wherein a signal indicating an abnormal state is outputted if the output of the density detector does not indicate the separated state when a predetermined time has passed after the press and separation driving device drove the transfer unit to be the separated state or when the press and separation driving device has driven the transfer unit to be the separated state a predetermined number of times.

5. The image forming apparatus according to claim 1, wherein a NIP width of the image carrier and the transfer unit is controlled in accordance with the output of the density detector.

6. A method for detecting a separated state of a transfer unit in an image forming apparatus having a structure in which a toner image formed in an electrophotographic process is transferred from an image carrier to a member to be transferred that becomes a pressure contact state with respect to the image carrier to make the image carrier perform a transfer process, the method comprising the steps of:

attaching a density detector for detecting a density of the toner image on the image carrier in such a way that a position or a posture of the density detector with respect to the image carrier is altered along with a movement of the transfer unit by the press and separation driving device; and detecting the pressure contact state or the separated state of the transfer unit based on a variation of a detection output of a bare surface state of the image carrier by the density detector.

* * * * *